US008408317B2

(12) United States Patent
Braddick

(10) Patent No.: US 8,408,317 B2
(45) Date of Patent: Apr. 2, 2013

(54) TUBULAR EXPANSION TOOL AND METHOD

(75) Inventor: Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 433 days.

(21) Appl. No.: 12/685,075

(22) Filed: Jan. 11, 2010

(65) Prior Publication Data

US 2011/0168411 A1 Jul. 14, 2011

(51) Int. Cl.
*E21B 23/08* (2006.01)

(52) U.S. Cl. ..... 166/383; 166/216; 166/217

(58) Field of Classification Search ..... 166/380, 166/383, 208, 382, 207, 209
See application file for complete search history.

(56) References Cited

U.S. PATENT DOCUMENTS

| | | | | |
|---|---|---|---|---|
| 1,815,376 | A * | 7/1931 | Jones | 294/86.22 |
| 2,021,223 | A * | 11/1935 | Church | 166/124 |
| 2,328,840 | A * | 9/1943 | O'Leary | 166/208 |
| 2,589,337 | A * | 3/1952 | Burns | 166/208 |
| 3,889,766 | A * | 6/1975 | Sutliff et al. | 175/297 |
| 4,497,367 | A * | 2/1985 | Stevenson | 166/208 |
| 4,562,889 | A * | 1/1986 | Braddick | 166/381 |
| 4,603,743 | A * | 8/1986 | Lindsey, Jr. | 166/382 |
| 5,222,555 | A * | 6/1993 | Bridges | 166/208 |
| 5,417,288 | A * | 5/1995 | Melenyzer et al. | 166/382 |
| 6,622,789 | B1 * | 9/2003 | Braddick | 166/277 |
| 6,631,759 | B2 * | 10/2003 | Cook et al. | 166/217 |
| 6,681,860 | B1 * | 1/2004 | Yokley et al. | 166/382 |
| 6,705,395 | B2 * | 3/2004 | Cook et al. | 166/207 |
| 6,722,427 | B2 * | 4/2004 | Gano et al. | 166/217 |
| 6,722,441 | B2 * | 4/2004 | Lauritzen et al. | 166/380 |
| 6,763,893 | B2 * | 7/2004 | Braddick | 166/382 |
| 6,814,143 | B2 * | 11/2004 | Braddick | 166/277 |
| 6,820,687 | B2 * | 11/2004 | Maguire et al. | 166/207 |
| 6,857,473 | B2 | 2/2005 | Cook et al. | |
| 6,892,819 | B2 | 5/2005 | Cook et al. | |
| 6,976,541 | B2 | 12/2005 | Brisco et al. | |
| 6,991,040 | B2 * | 1/2006 | Hill et al. | 166/373 |
| 7,017,670 | B2 * | 3/2006 | Hazel et al. | 166/382 |
| 7,021,390 | B2 | 4/2006 | Cook et al. | |
| 7,028,780 | B2 * | 4/2006 | Maguire | 166/382 |
| 7,055,608 | B2 | 6/2006 | Cook et al. | |
| 7,077,211 | B2 | 7/2006 | Cook et al. | |
| 7,086,477 | B2 * | 8/2006 | Duggan | 166/380 |
| 7,090,005 | B2 * | 8/2006 | Smith et al. | 166/206 |
| 7,117,940 | B2 * | 10/2006 | Campo | 166/207 |
| 7,140,442 | B2 * | 11/2006 | Mackay et al. | 166/380 |
| 7,172,025 | B2 * | 2/2007 | Eckerlin | 166/380 |
| 7,172,027 | B2 * | 2/2007 | Simpson et al. | 166/382 |
| 7,225,880 | B2 * | 6/2007 | Braddick | 166/382 |
| 7,278,492 | B2 * | 10/2007 | Braddick | 166/382 |
| 7,823,659 | B2 * | 11/2010 | Costa et al. | 175/57 |

(Continued)

*Primary Examiner* — Giovanna Wright
*Assistant Examiner* — Yong-Suk (Philip) Ro
(74) *Attorney, Agent, or Firm* — Streets & Steele

(57) ABSTRACT

A downhole hydraulically powered tool (10) moves an expander (36) in a well to radially expand a downhole tubular. The tool includes a plurality of fluid-powered pistons (16, 20) for axially stroking the expander relative to a tool mandrel (12), and one or more slips (52) for axially securing the tool in the well. The tool mandrel is rotatably secured to the tubular to rotate with the tubular, thereby rotating a bit (60) at the lower end of the tubular. The expander is moved axially downward in response to axial movement of the pistons to radially expand the tubular after at least a portion of the well is drilled with the bit and while the slips secure the tool in the well.

20 Claims, 3 Drawing Sheets

U.S. PATENT DOCUMENTS

| | | | | |
|---|---|---|---|---|
| 7,958,941 | B2 * | 6/2011 | Hueston et al. | 166/382 |
| 8,066,078 | B2 * | 11/2011 | Braddick | 166/380 |
| 8,069,916 | B2 * | 12/2011 | Giroux et al. | 166/212 |
| 8,100,188 | B2 * | 1/2012 | Watson | 166/382 |
| 8,132,627 | B2 * | 3/2012 | Braddick | 166/383 |
| 2001/0020532 | A1 * | 9/2001 | Baugh et al. | 166/285 |
| 2003/0102127 | A1 * | 6/2003 | Braddick | 166/277 |
| 2003/0121655 | A1 * | 7/2003 | Lauritzen et al. | 166/207 |
| 2003/0196818 | A1 * | 10/2003 | Lynde et al. | 166/382 |
| 2004/0016544 | A1 * | 1/2004 | Braddick | 166/277 |
| 2004/0050590 | A1 * | 3/2004 | Pirovolou et al. | 175/61 |
| 2004/0055758 | A1 * | 3/2004 | Brezinski et al. | 166/384 |
| 2004/0055786 | A1 * | 3/2004 | Maguire et al. | 175/50 |
| 2004/0129431 | A1 * | 7/2004 | Jackson | 166/384 |
| 2004/0149442 | A1 * | 8/2004 | Mackenzie | 166/297 |
| 2004/0216894 | A1 * | 11/2004 | Maguire | 166/384 |
| 2004/0231855 | A1 | 11/2004 | Cook et al. | |
| 2005/0056433 | A1 * | 3/2005 | Ring et al. | 166/384 |
| 2005/0092485 | A1 * | 5/2005 | Brezinski et al. | 166/207 |
| 2005/0161213 | A1 * | 7/2005 | Sonnier et al. | 166/207 |
| 2005/0263292 | A1 * | 12/2005 | Braddick | 166/382 |
| 2005/0263294 | A1 * | 12/2005 | Braddick | 166/382 |
| 2006/0124295 | A1 * | 6/2006 | Maguire | 166/207 |
| 2006/0156776 | A1 * | 7/2006 | Yablochnikov | 72/56 |
| 2007/0029095 | A1 * | 2/2007 | Brisco et al. | 166/380 |
| 2007/0114044 | A1 * | 5/2007 | Brezinski et al. | 166/386 |
| 2008/0156499 | A1 * | 7/2008 | Giroux et al. | 166/380 |
| 2008/0257560 | A1 * | 10/2008 | Brisco et al. | 166/377 |
| 2008/0277111 | A1 * | 11/2008 | Braddick | 166/206 |
| 2009/0242213 | A1 * | 10/2009 | Braddick | 166/384 |
| 2010/0155082 | A1 * | 6/2010 | Braddick | 166/380 |
| 2011/0132623 | A1 * | 6/2011 | Moeller | 166/382 |
| 2011/0186288 | A1 * | 8/2011 | Braddick | 166/208 |

* cited by examiner

TUBULAR EXPANSION TOOL AND METHOD

FIELD OF THE INVENTION

The present invention relates to equipment and techniques for radially expanding a downhole tubular in a well. More particularly, the present invention relates to a downhole tool for rotating a bit at the lower end of the tubular and thereafter moving an expander axially downward to expand the tubular as slips maintain tool outer sleeve secured to a lower portion of the tubular.

BACKGROUND OF THE INVENTION

Various types of downhole tools have been devised for radially expanding a tubular. In many applications, the expander is moved axially through the tubular in direct response to fluid pressure acting directly on the expander. Tools of this type are disclosed in U.S. Pat. Nos. 6,631,759, 6,857,473, 6,892,819, 6,976,541, 7,021,390, 7,055,608, and 7,077,211 and U.S. Publication 20040231855. Tools that pump the expander upward conventionally use an expander receiver housing with an enlarged diameter that frequently presents significant problems when positioning the receiver housing in the lower end of a well.

In other cases, a downhole tool utilizes a hydraulic section including a plurality of pistons connected in a series for axially moving the expander, as disclosed in U.S. Pat. Nos. 6,763,893, 6,814,143, 7,225,880, and 7,278,492. Expansion from the lower end of the tubular upward to an upper end of the tubular is disclosed. If desired, the tool may be collapsed and returned to the surface through the unexpanded upper portion of the tubular.

Techniques and equipment for expanding a tubular may vary considerably depending on the length of the tubular to be expanded. A short tubular section of 2 meters or less may be expanded in a liner hanger operation or a patch operation. Expansion of tubular lengths in excess of 500 meters and frequently thousands of meters are typically required for a mono-diameter expansion operation, with the added complexity of expanding hundreds of sealed threaded joints, which pose significantly greater problems than expansion of a short tubular section.

During the past decade, oilfield drilling operations which involve a drill bit at a lower end of casing have been used for some applications. The downhole casing may thus be rotated and simultaneously lowered in a well with the bit as the bit drills a deeper portion of the borehole. This casing drilling technique is not known to have been used in conjunction with a casing expansion operation, in part because of the complexity associated with a casing expansion operation, and the consequences of a failed expansion. A first trip in the hole has been employed to drill a portion of the borehole, and another trip in the hole may thereafter include an expander tool which then radially expands the tubular while positioned at a desired depth.

The disadvantages of the prior art are overcome by the present invention, and an improved technique for expanding a downhole tubular is hereinafter disclosed.

SUMMARY OF THE INVENTION

A hydraulically powered tool axially moves an expander in a well to radially expand a downhole tubular. In one embodiment, the tool includes a plurality of fluid powered pistons each interconnected in series for axially stroking the expander downward relative to a central tool mandrel. The tool mandrel is rotatably secured to the tubular to be expanded so that rotation of the work string rotates the mandrel, which rotates the tubular, which then rotates a bit at the lower end of the tubular. In a preferred embodiment, a splined connection is provided between the tool mandrel and the tubular. After a portion of the well is drilled, the expander is forced axially downward in response to the plurality of piston assemblies to radially expand a portion of the tubular while one or more slips secure an outer sleeve radially outward of the mandrel in the well. The tool includes a telescopic joint for expanding during an expander resetting operation and contracting during a tubular expansion operation. A method of operating the downhole hydraulically powered tool for achieving these goals is also disclosed.

These and further features and advantages of the present invention will become apparent from the following detailed description, wherein reference is made to the figures in the accompanying drawings.

DETAILED DESCRIPTION OF PREFERRED EMBODIMENTS

Figure 1:
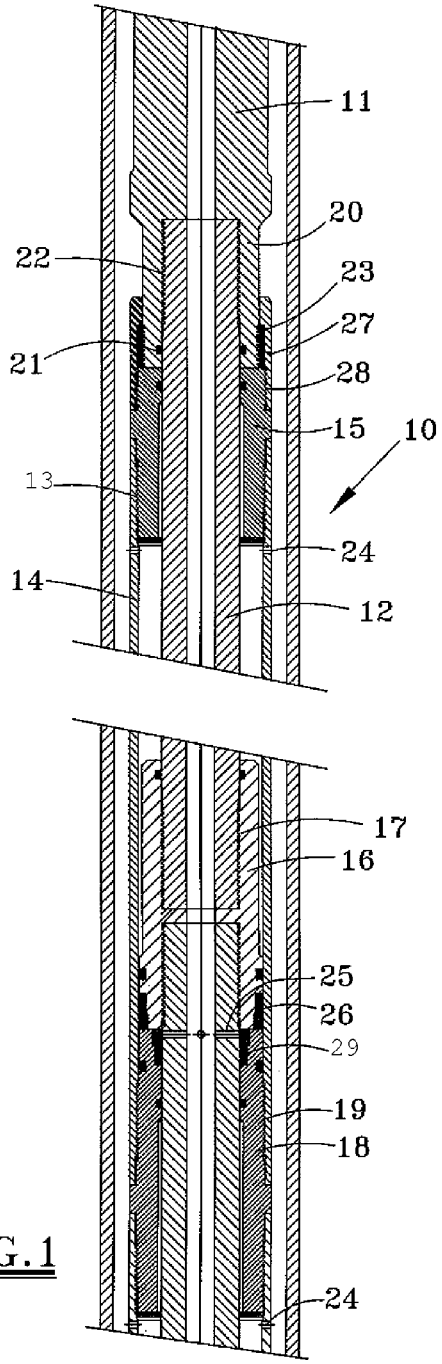
FIG. 1 is a cross-sectional view of an upper portion of the tool including the shear ring.

FIG. 1 discloses an upper portion of a suitable tool 10 including a mechanism discussed below for controlling premature operation during running or drilling operations. As shown in FIG. 1, the tool may be suspended in the well from drill pipe or work string 11, which supports both an inner tool mandrel 12 and an outer tubular 14. Threads 13 connect the outer tubular 14 to upper bushing 15. As shown in the lower portion of FIG. 1, an inner piston 16 is also connected by threads 17 to the mandrel 12, and is sealed to the outer tubular 14 by one or more o-ring seals or packing 26. Outer piston 18 is threaded at 19 to the outer tubular 14, with seal 29 sealing with the mandrel 12. A plurality of outer pistons and inner pistons are provided for serially powering the tool. The mandrel 12 is threaded at 22 to work string 11, and is sealed at 21 to the work string 11. Fluid pressure within the work string may pass through a port 25 (shown in the lower portion of FIG. 1) in the mandrel 12 (which is functionally an extension of the work string 11) to axially separate an outer piston 18 connected to outer tubular 14 from an inner piston 16 connected to inner work string 12, thereby providing the axial force to hydraulically actuate the tool. A vent port 24 in the outer tubular 14 may accommodate axial separation of the pistons during this operation. Those skilled in the art will appreciate that a series of inner and outer pistons may be provided, with a number of selected pistons depending upon the desired axial force to be exerted on the expander and the permissible working pressure within the work string 11. Further details regarding a hydraulically powered downhole actuator for both setting the tool in the well and expanding the downhole tubular are disclosed in U.S. Pat. Nos. 6,622,789 and 6,763,893.

A respective inner and outer piston may be axially connected when the tool is run in the well, and this connection broken after the drilling operation when the pistons separate to supply hydraulic power to the tool. Still referring to FIG. 1, sleeve 23, which acts as a stop, may be threaded to the lower end 20 of work string 11. During make-up of the assembly, connecting sleeve 28 may be positioned over the sleeve 23, and the threads between the sleeve 28 and the bushing 15 made-up so that the shoulder on the sleeve 28 engages the top end of the stop sleeve 23, thereby axially interconnecting the bushing 15 with the outer tubular 14. In a similar manner, the same components may be used to initially connect an outer piston and an inner piston. The sleeve 28 may include a recess, cut, or similar member reduction to desirably weaken the axial holding force of the sleeve 28, so that separation will occur at the location of the cut 27. Hydraulic force subsequently applied between the inner and outer pistons will thus shear the sleeve 28 at cut 27. The sleeve 28 effectively acts as a shear ring to prevent premature actuation of the tool. By keeping the pistons connected when the tool is run in the well, the likelihood of sand or debris getting trapped in the cavity between pistons is minimized. This cavity may also be filled with grease to prevent entry of sand or other solids between the pistons.

Figure 2:
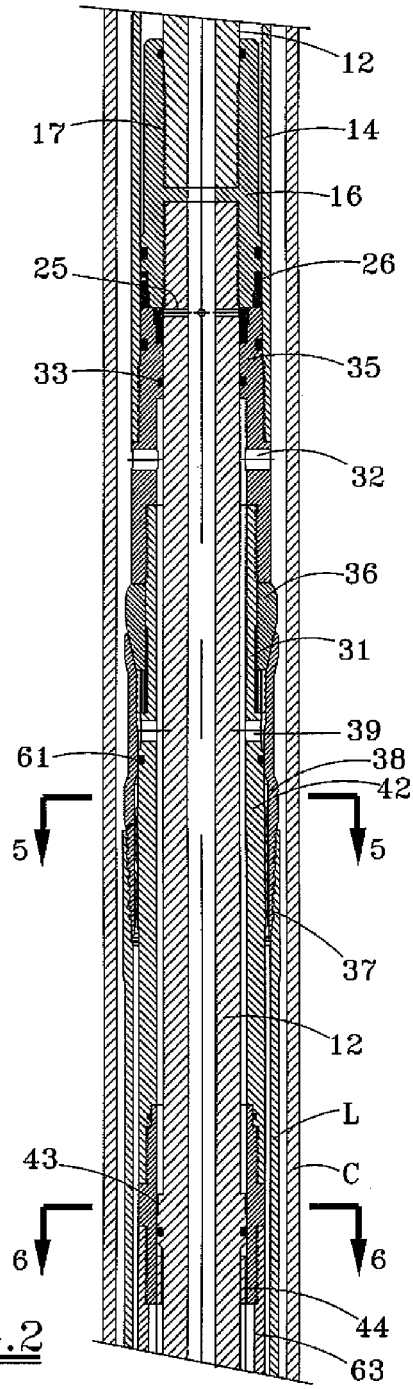
FIG. 2 illustrates a central portion of the tool shown in FIG. 1, including an expander powered to move axially downward to expand a tubular.
Figure 3:
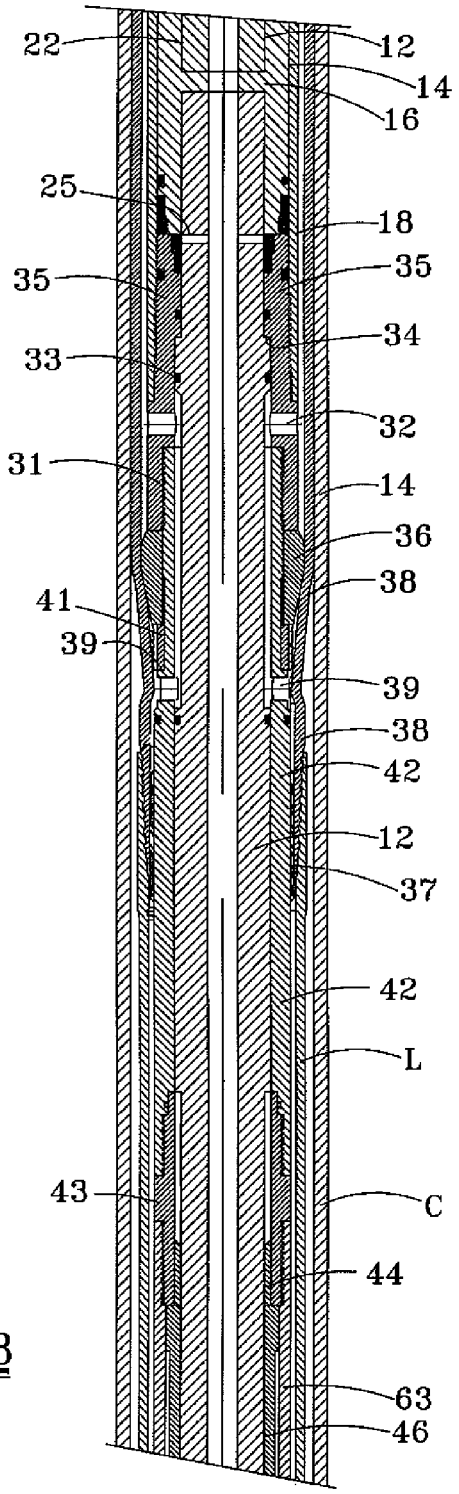
FIG. 3 illustrates the central portion of the tool shown in FIG. 1, with the telescopic joint in an expanded position.

FIG. 2 discloses a central portion of a suitable tool for both conducting a casing drilling operation and for thereafter expanding the liner internal diameter to greater than its run-in internal diameter. FIG. 3 discloses substantially the same portion of the tool when stroked to expand the liner. The tool may be used for drilling a portion of a well by powering a bit at a lower end of the casing (or liner), then expanding that same casing or liner while downhole in a well.

FIG. 2 illustrates an expander 36 on a central portion of tool 10 for expanding a tubular, such as liner L, after a portion of the well is drilled. The liner L may be positioned within a casing C, which may have been run in the well with an internal diameter greater than the OD of the liner, or the casing C may be a section of a liner which was expanded downhole to the diameter of casing C. End sleeve 35 is secured to the outer tubular 14. When end sleeve 35 is forced downward, this substantial axial force causes the sleeve 35 to move down with the expander 36. Only when the mandrel 12 is moved upward by energizing the hydraulic pistons may the expander 36 move downward. Seal 33 seals between the sleeve 35 and mandrel 12. Vent port 32 in sleeve 35 initially vents fluid pressure as the expander 36 moves down. The top of the casing or liner L, which includes the upper casing connector section 38, is threaded at 37 to the upper end of the main body of the liner L. The expander 36 is supported on the outer sleeve 41 (see FIG. 3) that is threadedly connected to upper casing connector 38. Sleeve 42 rests on coupling 43 threadedly connected to the outer sleeve 42, while the upper end of sleeve 42 is threaded at 31 to the lower end of sleeve 35. Port 39 passes fluid from below to above the expander only after the casing has been expanded, as explained below. Referring again to FIG. 2, seal 61 seals between outer sleeve 42 and the unexpanded liner L. The outer sleeve 42 as shown in FIG. 2 thus moves axially with the outer sleeve 14 shown in FIGS. 1 and 2.

Figure 4:
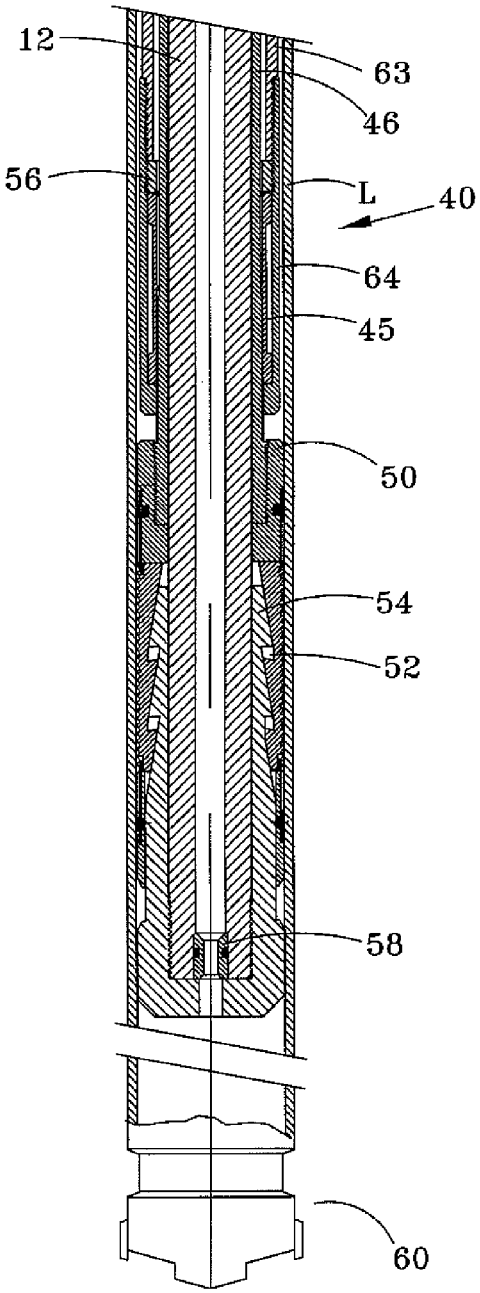
FIG. 4 illustrates a lower portion of the tool, including slips for securing an outer sleeve in the well, the telescoping joint in a collapsed position, and a drill bit at the lower end of the tubular.

It should be understood that the tool as shown in FIGS. 1 and 2 may be actuated to expand the liner L after the liner is first rotated by the tool and the work string 11 to rotate the bit 60 as shown in FIG. 4, thereby drilling a portion of the well to the desired depth. The liner L and the bit as a subassembly may be lowered in the well and suspended from the surface, then the remaining portions, including the tool and assembled casing connector section, made-up to the downhole subassembly. The work string, liner, and the bit may be lowered as an assembly to drilling depth and then rotated to drill the liner L into position in the well before expanding a section of liner within the well.

Referring again to FIG. 2, the coupling 43 is threaded to the bottom of outer sleeve 42, and includes internal splines 44 or another profile to rotate with mandrel 12, thereby rotating sleeve 42 above and below coupling 45 with the mandrel 12. Expander 36 is positioned within cage portion of end sleeve 35 which is threaded to outer sleeve 42 and supports sleeve 41 on shoulder 39 of sleeve 42, as shown in FIG. 2. Once the liner is properly positioned in the well by a liner drilling operation, the tool may then be activated to set the slips 52 as shown in FIG. 4, then the hydraulic pistons further actuated to force the expander 36 downward, thereby expanding the liner L. It should be noted that on occasion, the well bore may be drilled conventionally and the liner run and expanded subsequent to the drilling operation.

Referring still to FIG. 3, the tool mandrel 12, which as discussed above, is functionally integral with and part of the work string 11, supports both outer sleeve 42 and intermediate sleeve 63, with sleeve 63 functioning as a telescopic joint. Cage assembly 40, as shown in FIG. 4, is provided along with the telescopic joint 63, and includes upper ring 56 and collet mechanism 45 acting between the O.D. of sleeve 46 and the I.D. of the collet body 64. Collets 45 move radially inward and outward in response to axial movement of telescopic joint 63. Collets 45 are positioned within the cage body, and hold the slips 52 in an upward position, so that the slips do not inadvertently set. The collets 45 open radially outward permitting the slips to set, and reset the tool when the setting assembly is lowered. The action of a collet mechanism is thus repeatable, thereby allowing the tool to be repeatedly restroked. Cage assembly 40 thus holds telescopic joint 63 and the slips 52 in the downward position when the mandrel 12 is raised to set the slips.

Slip cage 50 is slidable about the lower end of the mandrel 12, is threadably secured to the lower end of the sleeve 46, and is furnished with pockets or apertures to support slips 52. Tapered surfaces on the slip actuator 54 are provided, so that as the actuator 54 moves upward with the mandrel 12 relative to the slips, the slips 52 radially move outward into gripping engagement with a portion of the liner L which is not yet expanded. The slip cage 50 slidably supports the slips while the mandrel moves upward. The ball seat 58 receives a ball to close off the interior of the work string 11 from the bit 60 to pressurize the interior of the work string to actuate the pistons.

The force generating pistons when energized will axially separate in response to the hydraulic pressure in the mandrel 12, thereby first setting the slips 52 and then driving the expander 36 downward relative to its initial position, thereby beginning expansion of the liner L. Once the slips 52 are set within the liner, the expander 36 is forced downward to expand a length of tubular. The inner pistons structurally connected to the mandrel 12 thus axially separate from the outer pistons during an expansion operation to generate sufficient force to drive the expander down after shearing a ring to separate the pistons. The process may be repeated for all lower sections of the tubular and that lower tubular expanded by stroking along the telescopic joint during an expander resetting operation, then collapsing the telescopic joint during a tubular expansion operation. Weight applied to the workstring may be used to collapse the telescopic joint and reposition the cage assembly 40.

A drill pipe or other work string is mechanically tied to the inner sleeve or mandrel, but the inner sleeve is not connected to the bit 60 and instead terminates below the slips and above the bit 60. The inner sleeve moves up to set the slips, and is subsequently set down to recock the assembly for an expansion operation. The outer sleeve pushes expander 36 down to expand the liner.

Figure 5:
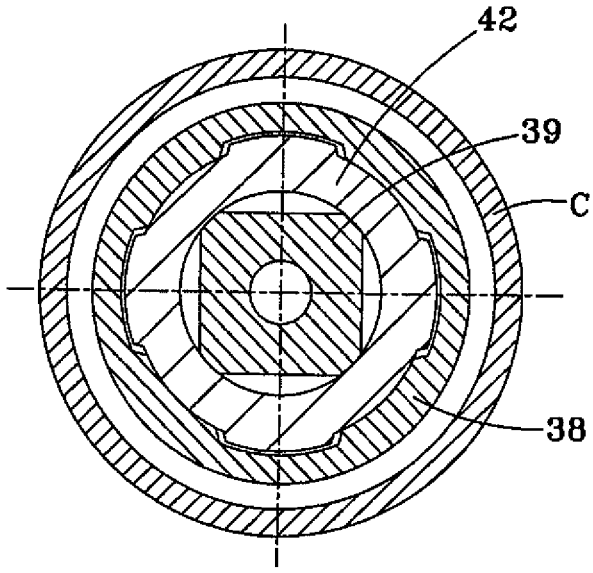
FIG. 5 is a cross-sectional view along lines 5-5 in FIG. 2.
Figure 6:
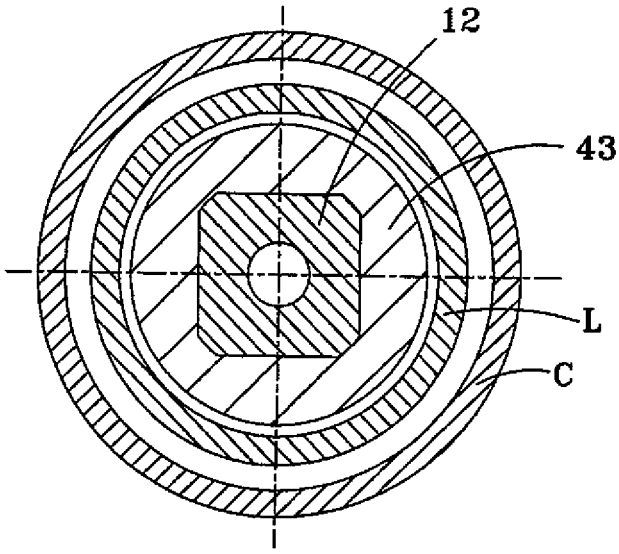
FIG. 6 is a cross-sectional view along lines 6-6 in FIG. 2.

The present invention allows an operator to insert a liner in a well, insert an expansion tool for engagement with the liner, then rotate the drill string to rotate the liner and a bit at the lower end of the liner and thereby drill a portion of the well, then subsequently expand the liner to a diameter substantially greater than its initial run-in diameter. More particularly, as shown in FIGS. 2 and 6, the mandrel 12 may have a section with a noncylindrical shape to fit within and rotate coupling 43 with the mandrel. This allows the telescopic joint 63 to be rotated along with the outer sleeve 42 as shown in FIG. 5. Rotation of sleeve 42 rotates the upper casing connector section 38, which then rotates the liner L. Liner drilling may occur prior to expansion of the liner. In most applications, the liner may be expanded to a diameter approximating the diameter of the bit as shown in FIG. 4, which is generally slightly larger than the maximum diameter of the expander 36. With this engagement, the plurality of pistons may be activated to push the expander downward during a liner expansion operation, then the drill string lowered to recock or reposition the tool for slip setting and expansion operation. Raising the drill string after recocking the tool will permit retrieval of the tool from the well. Prior to tubular expansion, the seal 61 between the outer tubular 42 and the top of the liner L effectively prevents fluid from passing upward between the outside of the tool and the liner L. After expansion has occurred, the seal 61 as shown in FIG. 2 inherently is broken by movement of the expander 36, so that well fluid from below the tool may be evacuated to a position above the tool as the liner is expanded. Although the mandrel is rotatably tied to the outer tubular by a spline connection, e.g. spline 44, and the outer tubular is rotatably tied to the tubular to be expanded by another splined connection, as shown in FIG. 5, the selective rotatable connections can be accomplished by other mechanisms, although a spline connection is particularly well-suited for the purposes of this invention.

Expansion of the tubular from the top down offers several advantages compared to expansion of the tubular from the bottom up, including the possibility of retrieving the expander and tool through the previously expanded tubular. The ability to close off and control the annulus outside the tubular if the well commences to flow during tubular expansion is obtained with top-down expansion, but is not available with bottom-up expansion.

A significant advantage of the tool as disclosed herein is that fluid pressure does not act directly upon the expander to cause the expansion operation. More importantly, in the event that one of the threaded joints in the expanded liner leaks, this leakage will not inhibit the continued expansion of the liner, which is a significant advantage compared to prior art systems which rely upon fluid pressure directly acting on the expander to move the expander.

The arrangement of the components according to the present invention positions the hydraulic power source, which per the disclosed embodiments is a plurality of inner and outer pistons, above the expander, and then positions the anchor below the expander. Also, this design includes a telescopic joint within the tool, while such a joint is not required according to the prior art tools of the type disclosed in U.S. Pat. No. 7,225,880.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A downhole hydraulically powered tool for axially moving an expander in a well to radially expand a tubular, comprising:

a plurality of fluid powered pistons for axially stroking the expander downward relative to a tool mandrel;

one or more slips for axially securing an outer sleeve radially outward of the tool mandrel in the well;

the tool mandrel rotatably secured to the outer sleeve by a splined connection to rotate the tubular by rotating a work string rotatably secured to the tool mandrel, and the outer sleeve rotatably secured to the tubular, the tool mandrel having a central fluid passageway and a plurality of ports for passing fluid to the plurality of fluid powered pistons;

a drill bit rotatably secured to a lower end of the tubular to drill at least a portion of the well; and the expander movable axially downward relative to the tool mandrel in response to axial movement of the plurality of pistons to radially expand the tubular after drilling at least a portion of the well by rotating the work string, the outer sleeve and the tubular, and then disabling the splined connection while the one or more slips secure the outer sleeve in the well.

2. A downhole tool as defined in claim 1, wherein the tool is lowered in the well on the work string, and a fluid passageway in the work string and a central bore in the tool mandrel supply fluid pressure to power the plurality of pistons and to cool the rotating bit.

3. A downhole tool as defined in claim 1, further comprising:

a telescopic joint for contracting during a tubular expansion operation and expanding during an expander resetting operation.

4. A downhole tool as defined in claim 3, wherein the tool mandrel transmits set down weight to expand the telescopic joint during the expander resetting operation.

5. A downhole tool as defined in claim 1, further comprising:

another splined connection between the outer sleeve and the tubular.

6. A downhole tool as defined in claim 5, wherein the another splined connection is between the outer sleeve and a tubular extension member secured to an end of the tubular; and a seal between the tool mandrel and the tubular extension member.

7. A downhole tool as defined in claim 1, wherein the expander is positioned axially between the plurality of fluid powered pistons and the one or more slips.

8. A downhole tool as defined in claim 1, further comprising:

a frangible member for axially interconnecting an inner one of the plurality of pistons and an outer one of the plurality of pistons when the tool is run in a well.

9. A downhole hydraulically powered tool for positioning in a well on a work string for axially moving an expander in the well to radially expand a downhole tubular, comprising:

a plurality of fluid powered pistons each connected in series for axially stroking the expander downward relative to a tool mandrel, the work string being rotatably secured to the tool mandrel;

one or more slips for axially securing an outer sleeve radially outward of the tool mandrel in the well;

a splined connection between the tool mandrel and an outer sleeve, and another splined connection between the outer sleeve and the tubular, such that rotation of the tool mandrel rotates the tubular;

a drill bit rotatably secured to a lower end of the tubular to drill at least a portion of the well;

the expander movable axially downward relative to the tool mandrel in response to axial movement of the plurality of pistons to radially expand the tubular after drilling at least a portion of the well and while the one or more slips secure the outer sleeve in the well; and a telescopic joint for expanding during an expander resetting operation and contracting during a tubular expansion operation.

10. A downhole tool as defined in claim 9, wherein the tool mandrel transmits set down weight to expand the telescopic joint during the expander resetting operation.

11. A downhole tool as defined in claim 9, wherein the expander is positioned axially between the plurality of fluid powered pistons and the one or more slips.

12. A downhole tool as defined in claim 9, wherein the another splined connection is between the outer sleeve and a tubular extension member secured to an end of the tubular; and a seal between the tool mandrel and the tubular extension member.

13. A downhole tool as defined in claim 9, wherein the tool is lowered in the well on the work string, and a fluid passageway in the work string and a central bore in the tool mandrel supply fluid pressure to power the plurality of pistons and to cool the rotating bit.

14. A method of operating a downhole hydraulically powered tool positioned in a well on a work string for axially moving an expander in the well to radially expand a downhole tubular, comprising:

providing a plurality of fluid powered pistons each interconnected in series for axially stroking the expander relative to a tool mandrel, the work string being rotatably secured to the tool mandrel;

rotating the work string to rotate the tool mandrel and thereby rotate an outer sleeve by a splined connection with the tool mandrel, the outer sleeve rotating the downhole tubular and thereby rotating a bit at a lower end of the downhole tubular to drill at least a portion of the well;

axially securing one or more slips to an outer sleeve radially outward of the tool mandrel in the well; and moving the expander axially downward relative to the tool mandrel in response to axial movement of the plurality of pistons to radially expand a portion of the downhole tubular after drilling at least a portion of the well and while the one or more slips secure the outer sleeve in the well.

15. A method as defined in claim 14, further comprising:

providing a telescopic joint for expanding during an expander resetting operation and contracting during a downhole tubular expansion operation.

16. A method as defined in claim 14, wherein the tool mandrel transmits set down weight to expand the telescopic joint during the expander resetting operation.

17. A method as defined in claim 14, wherein the tool is lowered in the well on the work string, and a fluid passageway in the work string and a central bore in the tool mandrel supply fluid pressure to power the plurality of pistons and to cool the rotating bit.

18. A method as defined in claim 14, wherein the expander is positioned axially between the plurality of fluid powered pistons and the one or more slips.

19. A method as defined in claim 14, further comprising:

axially interconnecting an inner one of the plurality of pistons and an outer one of the plurality of pistons with a frangible member when the tool is run in a well.

20. The method as defined in claim 14, further comprising:

sealing between the tool mandrel and the downhole tubular to be expanded prior to expansion of the downhole tubular.

* * * * *